US008286706B2

(12) United States Patent
McCann et al.

(10) Patent No.: US 8,286,706 B2
(45) Date of Patent: Oct. 16, 2012

(54) PRESSURE COMPENSATION FOR A PERFORATING GUN

(75) Inventors: Jason W. McCann, Cypress, TX (US); Mark Sloan, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 349 days.

(21) Appl. No.: 12/732,943

(22) Filed: Mar. 26, 2010

(65) Prior Publication Data

US 2010/0243323 A1 Sep. 30, 2010

Related U.S. Application Data

(60) Provisional application No. 61/163,705, filed on Mar. 26, 2009.

(51) Int. Cl.
*E21B 43/116* (2006.01)

(52) U.S. Cl. ..... 166/297; 166/298; 89/1.15; 102/310

(58) Field of Classification Search ..... 89/1.15; 102/310, 312, 320, 324; 166/62, 297, 298
See application file for complete search history.

(56) References Cited

U.S. PATENT DOCUMENTS 2,742,857 A * 4/1956 Turechek ..... 102/310
2,833,215 A * 5/1958 Lloyd ..... 175/4.54
4,749,039 A 6/1988 Vann et al.
5,259,316 A * 11/1993 Nelson et al. ..... 102/312
5,775,426 A * 7/1998 Snider et al. ..... 166/308.1
7,210,524 B2 5/2007 Sloan et al.
7,231,982 B2 6/2007 Sloan et al.
2003/0102162 A1 6/2003 Sloan et al.
2005/0236183 A1 10/2005 Grove
2007/0053785 A1 * 3/2007 Hetz et al. ..... 419/42

OTHER PUBLICATIONS

International Preliminary Report on Patentability for PCT/US2010/028895, dated Sep. 27, 2011, 4 pages.
International Search Report and Written Opinion for PCT/US 2010/028895, dated Oct. 4, 2010, 6 pages.

* cited by examiner

*Primary Examiner* — William P Neuder
*Assistant Examiner* — Richard Alker
(74) *Attorney, Agent, or Firm* — Bracewell & Giuliani LLP

(57) ABSTRACT

A perforating system having a perforating gun with a pressurizable gun body. The gun body can be pressurized prior to deployment in a wellbore, or while in the wellbore. Pressurizing the gun body can include adding fluid into the gun body, such as a pressurized gas, a liquid, or combustion products. A seal diaphragm can be used to transfer wellbore pressure into the gun body.

11 Claims, 5 Drawing Sheets

Fig. 5B
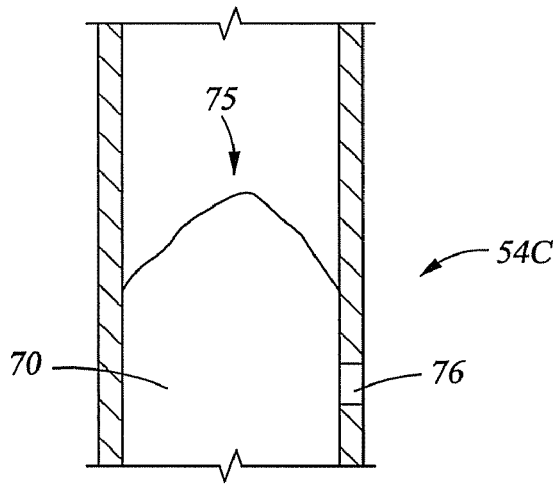
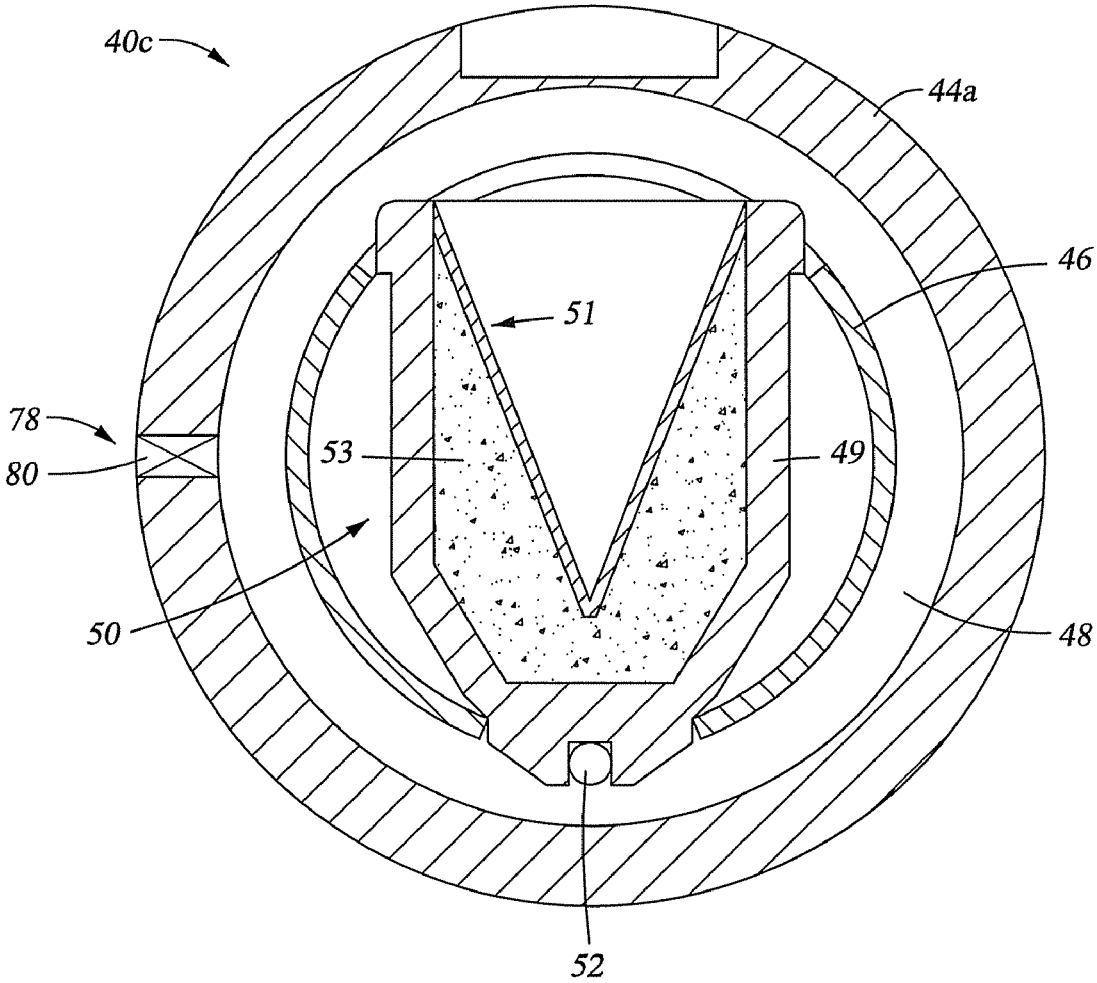
Fig. 6

PRESSURE COMPENSATION FOR A PERFORATING GUN

CROSS REFERENCE TO RELATED APPLICATIONS

This application claims priority to and the benefit of co-pending U.S. Provisional Application Ser. No. 61/163,705, filed Mar. 26, 2009, the full disclosure of which is hereby incorporated by reference herein.

BACKGROUND

1. Field of Invention

The invention relates generally to the field of oil and gas production. More specifically, the present invention relates to a perforating system having a system for compensating pressure inside a perforating gun body with wellbore pressure.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

Perforating systems typically comprise one or more perforating guns strung together, these strings of guns can sometimes surpass a thousand feet of perforating length. In FIG. 1 an example of a perforating system 4 is shown. For the sake of clarity, the perforating system 4 depicted comprises a single perforating gun 6 instead of the typical multitude of guns. The perforating gun 6 is shown disposed within a wellbore 1 on a wireline 5. The perforating system 4 as shown also includes a service truck 7 on the surface 9, where in addition to providing a raising and lowering means, the wireline 5 also provides communication and control connectivity between the truck 7 and the perforating gun 6. The wireline 5 is threaded through pulleys 3 supported above the wellbore 1. As is known, derricks, slips and other similar systems may be used in lieu of a surface truck for inserting and retrieving the perforating system into and from a wellbore. Moreover, perforating systems may also be disposed into a wellbore via tubing, drill pipe, slick line, coiled tubing, to mention a few.

Included with the perforating gun 6 are shaped charges 8 that typically include a housing, a liner, and a quantity of high explosive inserted between the liner and the housing. When the high explosive is detonated, the force of the detonation collapses the liner and ejects it from one end of the charge 8 at very high velocity in a pattern called a "jet" 12. The jet 12 perforates the casing and the cement and creates a perforation 10 that extends into the surrounding formation 2.

FIG. 2 illustrates in side partial sectional view an example of a prior art perforating gun 6. The perforating gun 6 includes an annular gun tube 16 in which the shaped charges 8 are arranged in a phased pattern. The gun tube 16 is coaxially disposed within an annular gun body 14. On an end of the perforating gun 6 is an end cap 20 shown threadingly attached to the gun body 14. On the end of the perforating gun 6 opposite the end cap 20 is a lower sub 22, also threadingly attached to the gun body 14. The lower sub 22 includes a chamber shown having an electrical cord 24 attached to a detonator 26. A detonating cord 28 is included shown having an end connected to the detonator 26 and wound around the gun tube 16 for connection to the lower end of each shaped charge 8. As is known, an associated firing head (not shown) can emit an electrical signal that transferred through the electrical cord 24 and to the detonator 26 for igniting the detonating cord 28 to then detonate the shaped charge 8.

An annulus 18 is formed between the gun body 14 and gun tube 16 that typically is at a pressure substantially the atmospheric pressure of the location where the perforating gun 6 is assembled—which is generally about 0 pounds per square inch gauge (psig). Thus at surface 9, no differential pressure is exerted on the gun body 14. However, wellbore fluids in a wellbore 1 can generate static head pressure that often exceeds 5,000 psig. Thus when the perforating gun 6 is deployed at depth within the wellbore 1, the gun body 14 will experience a significant differential pressure. The large pressure difference across the gun body 14 wall requires thicker and stronger walls to enhance their strength, as well as robust seals in a perforating gun 6.

SUMMARY OF INVENTION

Disclosed herein is a perforating system having a perforating gun with an equalized pressure. The space within the perforating gun body can be pressurized to reduce or eliminate the pressure differential caused by downhole fluid static pressure. The gun body can be pressurized prior to being deployed within a wellbore or can be activated downhole. Optionally, a sealing system can translate downhole pressure to within the gun body for equalizing purposes. Equalizing can occur through a sliding piston or a bladder that transmits pressure.

Also disclosed is an example of a method of perforating that includes pressurizing within a gun body of a perforating system. The perforating system is deployed into a wellbore and shaped charges within the gun body are detonated to create perforations in a side of the wellbore. The step of pressurizing can occur before or after the gun body is inserted into the wellbore. Example methods of pressurizing include: injecting fluid into the gun body to increase pressure therein as well as equalizing pressure in the gun body with ambient pressure to minimize pressure differential across the wall of the gun body.

BRIEF DESCRIPTION OF DRAWINGS

Some of the features and benefits of the present invention having been stated, others will become apparent as the description proceeds when taken in conjunction with the accompanying drawings, in which:

FIG. 5B is a side sectional view of an embodiment of a perforating gun having an expandable bladder.

FIG. 6 is an axial sectional view of an embodiment of a perforating gun in accordance with the present disclosure.

Figure 1:
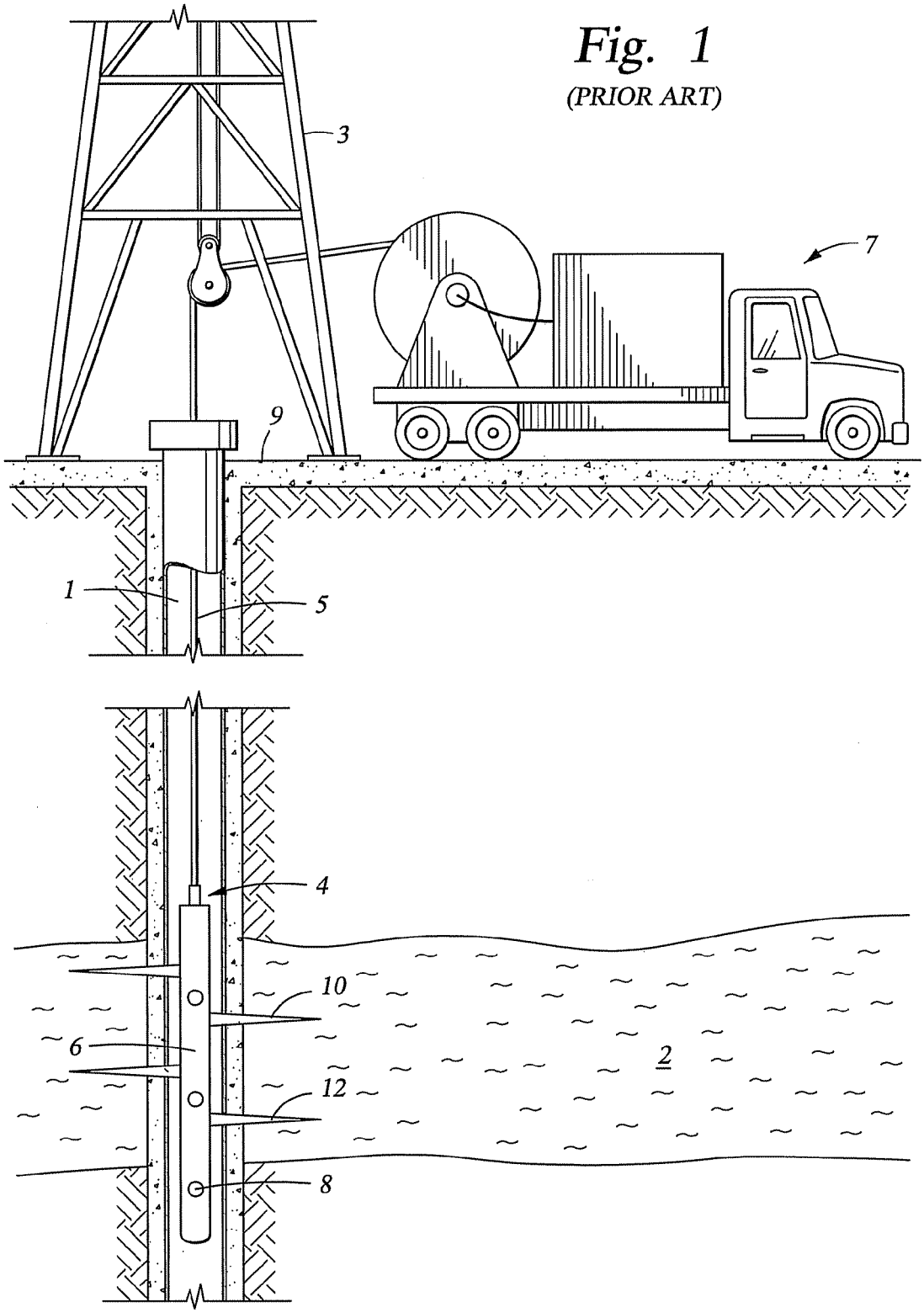
Fig. 1 (PRIOR ART)
FIG. 1 is partial cutaway side view of a prior art perforating system in a wellbore.
Figure 2:
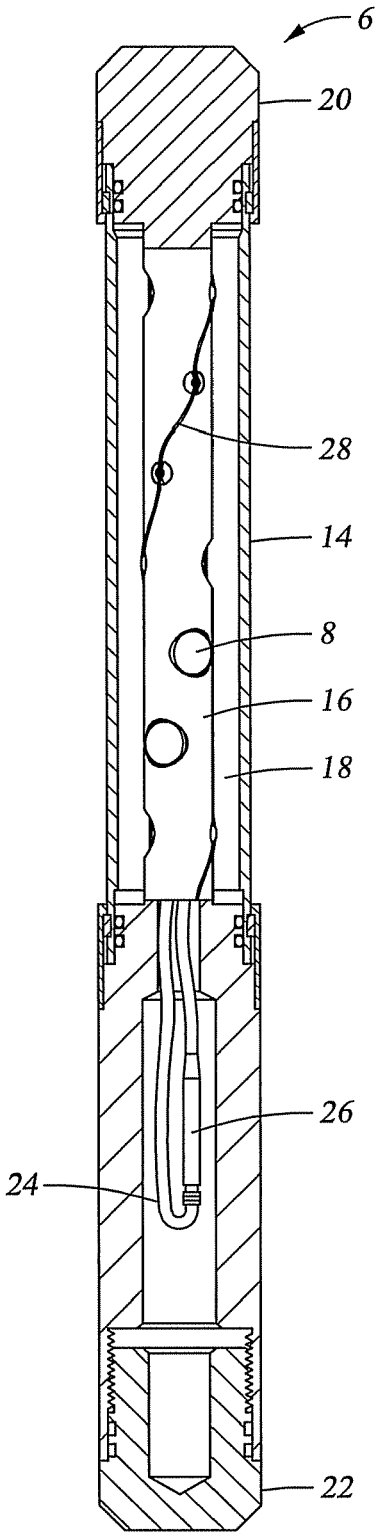
Fig. 2 (PRIOR ART)
FIG. 2 is a side sectional view of a prior art perforating gun.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

Figure 3:
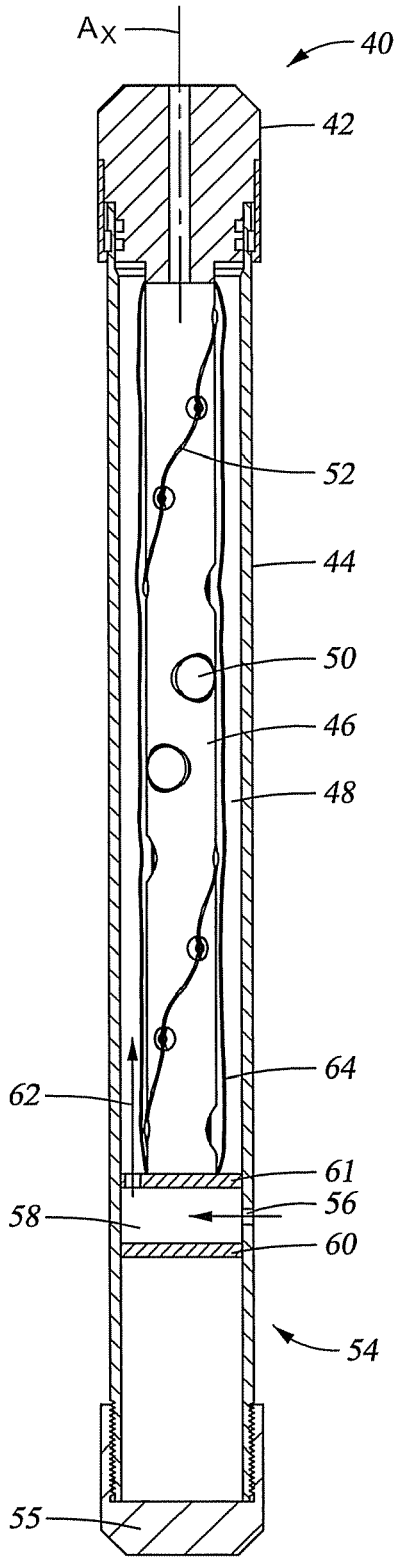
FIG. 3 is a side sectional view of an embodiment of a perforating gun having an equalizing bladder.

With reference now to FIG. 3 an example of a perforating gun 40 is provided in a side partial sectional view. As shown, the perforating gun 40 includes an annular gun body 44 having an upper end cap 42 coaxially attached at one end and lower end cap 55 on an opposite end. A lower sub 54 is coaxially defined within an end of the gun body 44 opposite the upper end cap 42. In the example of FIG. 3, the lower sub 54 is a tubular segment coaxial with the gun body 44 and capped with the lower end cap 55. Coaxially secured within a portion of the gun body 44 is a gun tube 46 thereby defining an open space annulus 48 (also referred to herein as a plenum) between the gun tube 46 and gun body 44. The gun tube 46 is an annular member with apertures formed through the side wall and shaped charges 50 inserted within the apertures; a detonating cord 52 is shown connecting to each of the shaped charges 50. In the embodiment shown, a bladder 64 encases the gun tube 46 on its outer surface providing a sealing barrier between the gun tube 46 and the annulus 48. The bladder 64 can be a flexible member made from an elastomer or other polymer material, or can also be a foil-like metal. In the example of FIG. 3, the bladder 64 is a sleevelike member having ends attachable to either the outer surface of the gun tube 46 or the end cap 42/bulkhead 61.

A solid bulkhead 61 is shown mounted in the gun body 44 and in a plane transverse to an axis $A_X$ of the perforating gun 40. In an example, the bulkhead 61 defines the lower end of the gun body 44 and upper end of the lower sub 54. Bulkhead 61 spans the entire space within the gun body 44. A lower bulkhead 60 is shown provided within the lower sub 54 in a plane substantially parallel to that of the first bulkhead 61 and defining a chamber 58 between the bulkheads 60, 61. An orifice 56 formed through a lateral wall of the gun body 44 provides fluid communication between the chamber 58 and the space surrounding the perforating gun 40. For example, prior to deployment the chamber 58 would freely communicate air at atmospheric pressure through the orifice 56. Similarly, when deployed in a fluid filled wellbore, wellbore fluid can flow into the chamber 58 through the orifice 56 driven by the higher pressure in the wellbore. Eventually, as the wellbore fluid enters the chamber 58, the pressure in the chamber 58 equalizes with wellbore pressure. A passage 62 axially formed through the bulkhead 61 provides fluid communication from the chamber 58 into the annulus 48 in the space between the gun body 44 and the bladder 64. The fluid communication from the space ambient the perforating gun 40 into the annulus 48 pressurizes the annulus 48 to substantially ambient pressure thereby minimizing pressure differential across the wall of the gun body 44. The bladder 64 prevents fluid migration into the gun tube 46, thus avoiding damaging or fouling the shaped charge 50 by wellbore fluid.

Figure 4:
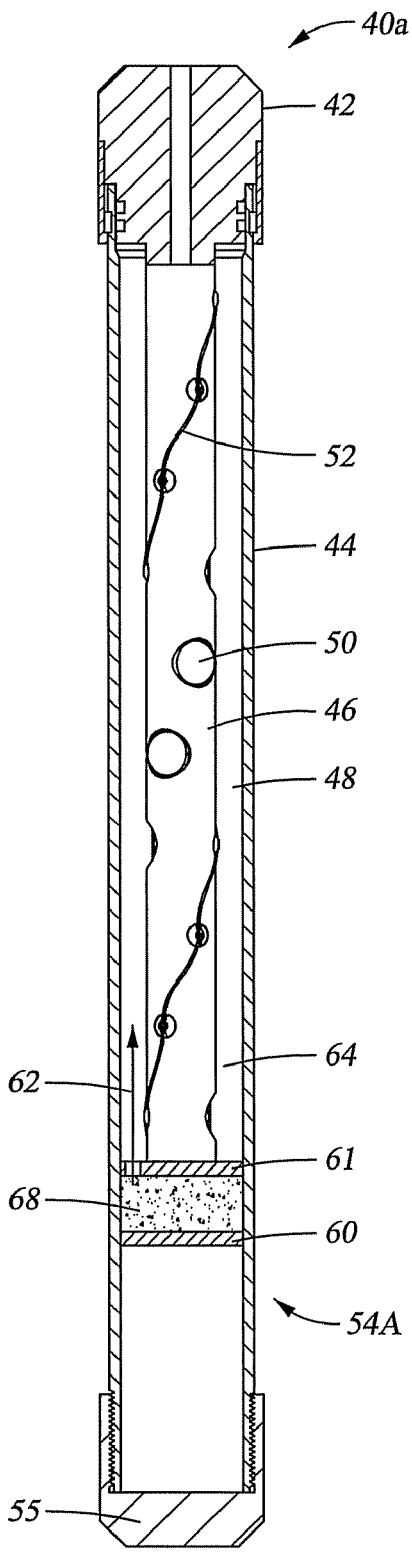
FIG. 4 is a side sectional view of an embodiment of a perforating gun having a combustible material.

Shown in FIG. 4 is a side sectional view of an embodiment of a perforating gun 40A that includes an oxidizing material for pressurizing within the gun body 44. In this example embodiment, the bulkheads 61, 60 are shown substantially the same as the embodiment of FIG. 3; including the passage 62 formed through the first bulkhead 61. Added in this embodiment is an oxidizing agent 68 within the chamber 58 between the gun tube 46 and lower sub 54A. An example oxidizing agent 68 is combustible, and can also combust in the absence of oxygen or when exposed to wellbore fluid. In the example of FIG. 4, the oxidizing agent 68 is in the process of being combusted and producing off gases. Arrows illustrate flow of the off gases from within the chamber 58, through the passage 62, and into the annulus 48. The combustion off gas pressurizes the annulus 48 to substantially reduce or eliminate stresses on the gun body 44 from an applied pressure differential. Other alternatives for use in the chamber 58 to produce pressure within the gun body 44 include chemical reactions, gas generators or slow burn elements.

Figure 5A:
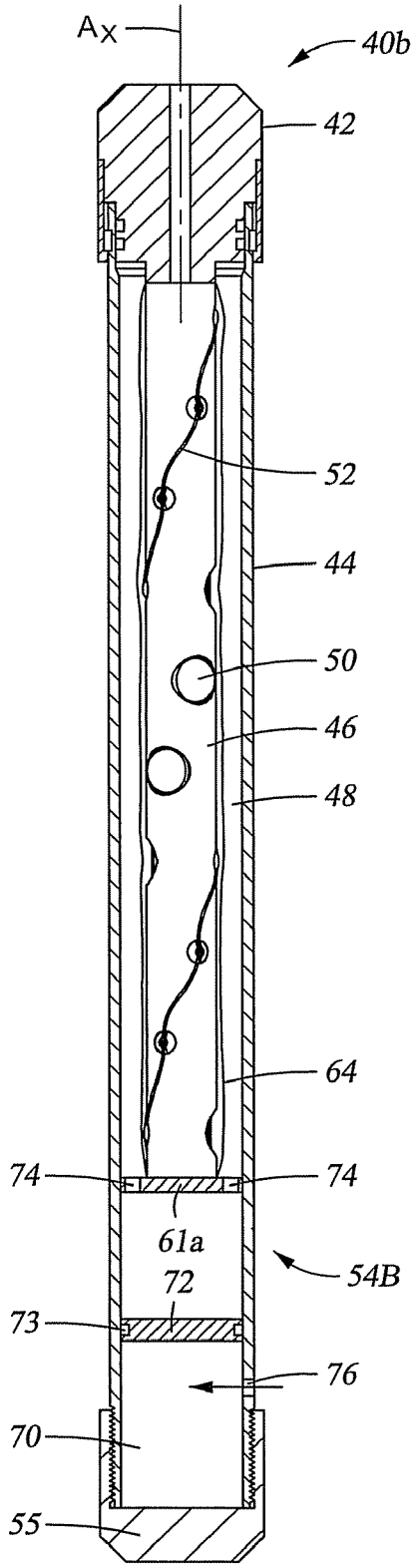
FIG. 5A is a side sectional view of an embodiment of a perforating gun having a slidable piston.

With reference now to FIG. 5A, an alternative example of a perforating gun 40B is shown in a side partially sectional view. In this embodiment, the perforating gun 40B includes a gun body 44, an end cap 42 on the end of the gun body 44, and a lower sub 54B on the gun body 44 end opposite the end cap 42. The gun tube 46 is shown axially anchored within the gun body 44 defining an annulus 48 between the gun body 44 and gun tube 46. In this example, a bulkhead 61A is at the lower terminal end of the gun tube 46 to form a boundary between the gun body 44 and lower sub 54B. The lower sub 54B is shown as a largely annular member having an open space with a pressure chamber 70. A piston 72 is coaxially provided in the pressure chamber 70 and having seals 73 optionally provided on the outer radial periphery of the piston 72. The piston 72 is axially moveable within the pressure chamber 70; a pressure differential axially applied across the piston 72 can urge the piston 72 within the pressure chamber 70 in a direction along the axis $A_X$. A port 76 is shown formed on through a lateral wall of the lower sub 54B allowing fluid and pressure communication into the pressure chamber 70 on a side of the piston 72 opposite from the bulkhead 61A. When the perforating gun 40B is in a wellbore, higher pressure wellbore fluid can flow through the port 76 and into the pressure chamber 70 and urge the piston 72 upwards towards the bulkhead 61A. Passages 74 are axially formed through the bulkhead 61A allowing fluid communication between the chamber 70 and the annulus 48. A fluid such as hydraulic fluid, air, an inert gas, nitrogen, combinations thereof and the like, can be in the annulus 48 and in pressure chamber 70 between the bulkhead 61A and the piston 72. The fluid can be at atmospheric pressure, or pressurized above atmospheric. Urging the piston 72 towards the bulkhead 61A pressurizes the fluid in the annulus 48 and chamber 70 thereby to equalize pressure in the annulus 48 with ambient pressure to minimize gun body 44 wall differential pressure. Alternatively, the piston 72 can be replaced with an expandable bladder 75 shown having ends sealed within the chamber 70 and along an inner circumference of the chamber 70. The bladder 75 can include folds so that when fluid enters the chamber 70 through the port 76, the bladder 75 "unfolds" towards the gun tube 46 and pressurizes the pressurizing fluid in the annulus 48 and side of the bladder 75 facing the gun tube 46.

Referring now to FIG. 6, an example of a perforating gun 40C is shown in a partially sectional axially view. In this embodiment, a valve 78 is provided through an opening 80 formed in the wall of the gun body 44A. A pressurized gas, such as nitrogen or air, can be injected through the valve 78 and into the annulus 48 between the gun body 44*a* and gun tube 46. Deploying a relatively inert gas, such as nitrogen, reduces chances of harm to the shaped charge 50, detonating cord 52, or associated electronics (not shown). In this example, the shaped charge 50 includes a case 49, a liner 51 in the case, 49, and high explosive 53 between the liner 51 and case 49. Pressurizing the space in the annulus 48 increases the pressure within the gun body 44A which in turn can minimize pressure differentials across the wall of the gun body 44 as the gun 40C is disposed in a pressurized wellbore. As is known, detonating the high explosive 53, produces a force to expel the liner 51 from the case 49. The liner 51 is further inverted by the explosive force into a metal jet used to perforate a formation adjacent a wellbore.

Figure 7:
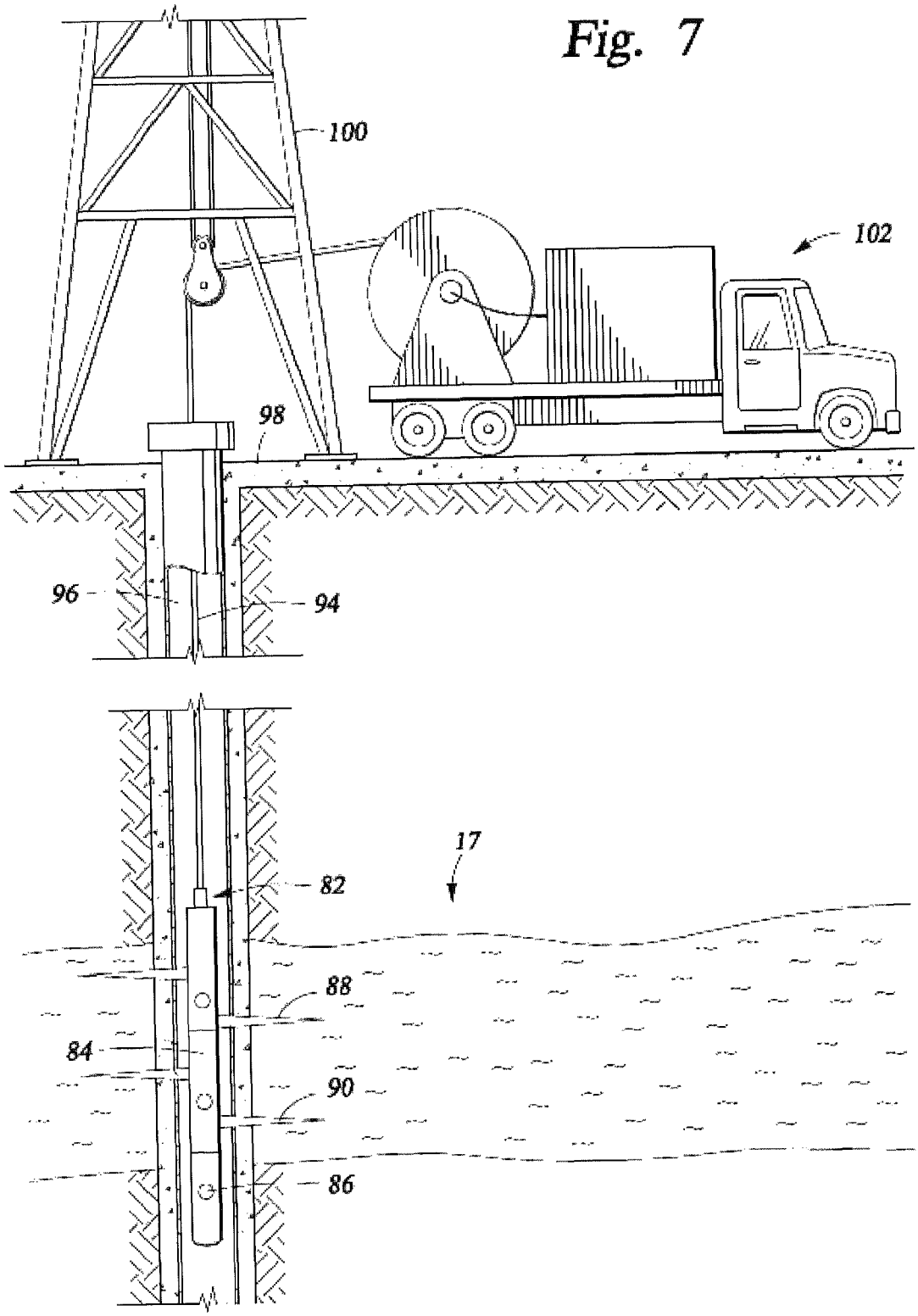
FIG. 7 is a side partial sectional view of a perforating system as described herein deployed in a wellbore.

Illustrated in a side partial sectional view in FIG. 7 is an example of use of a perforating system as described herein deployed within a wellbore 96 on a wireline 94. In this example, a perforating system 82 is shown having multiple perforating guns 84 that can be the same or similar to the perforating guns 40, 40A, 40B, 40C described in FIGS. 3-6. While deployed in the wellbore 96, shaped charges 86 in the perforating system 82 can be detonated to emit metal jets 88 that form perforations 90 within the adjoining subterranean formation 92. A surface truck 102 is shown at surface 98 for raising/lowering, and communicating with the gun string. The wireline 94 attaches the string with the surface truck 102 and is wound through pulleys 10 in a derrick structure. Advantages of reducing the pressure differential across the wall of the gun body 44 are reduced size and weight of the gun body 44, that can result in more and/or larger shaped charges 50 included with a perforating gun and a perforating gun system.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A perforating system comprising;

a gun body;

a gun tube in the gun body;

shaped charges in the gun tube and having a case, a liner in the case, and high explosive between the liner and the case;

an annulus between the gun tube and gun body pressurized to a pressure exceeding atmospheric pressure;

a bladder within the gun body encapsulating the gun tube and having ends connected to a surface adjacent the gun tube and along an interface circumscribing an axis of the gun body; and a port formed through a sidewall of the gun body in fluid communication with a space in the annulus and between the bladder and an inner surface of the gun body, so that when fluid ambient to the gun body is at a pressure exceeding atmospheric pressure, the fluid flows through the port and into the space thereby minimizing pressure differential across the gun body.

2. The perforating system of claim 1, further comprising an equalizing system for equalizing pressure in the annulus with wellbore pressure.

3. The perforating system of claim 1, wherein the gun body comprises a first gun body, the system further comprising a second gun body attached to the first gun body, a wireline having a lower end suspending the first and second gun bodies in a wellbore, and a surface control attached to an upper end of the wireline.

4. The perforating system of claim 1, wherein the surface comprises an outer surface of the gun tube.

5. The perforating system of claim 1, wherein the surface comprises a bulkhead transversely mounted in the gun body, so that the ends of the bladder are spaced radially outward from an outer surface of the gun tube.

6. The perforating system of claim 1, wherein the surface comprises an end cap coaxially mounted to an end of the gun tube, so that the ends of the bladder are spaced radially outward from an outer surface of the gun tube.

7. A perforating system comprising;

a gun body insertable into a wellbore;

a gun tube coaxially disposed in the gun body and defining an annulus therebetween;

shaped charges in the gun tube and having a case, a liner in the case, and high explosive between the liner and the case;

a pressure equalizing system for communicating pressure ambient to the gun body to the annulus;

a bladder within the gun body encapsulating the gun tube and having ends connected to a surface adjacent the gun tube and along an interface circumscribing an axis of the gun body; and a port formed through a sidewall of the gun body in fluid communication with a space in the annulus and between the bladder and an inner surface of the gun body, so that when fluid ambient to the gun body is at a pressure exceeding atmospheric pressure the fluid flows through the port and into the space thereby minimizing pressure differential across the gun body.

8. The perforating system of claim 7, wherein the gun body comprises a first gun body, the system further comprising a second gun body attached to the first gun body, a wireline having a lower end suspending the first and second gun bodies in a wellbore, and a surface control attached to an upper end of the wireline.

9. A method of perforating comprising:

providing a perforating gun comprising, a gun body, a gun tube inserted within the gun body to form an annulus between the gun body and gun tube, and shaped charges in the gun tube, the shaped charges having a case, a liner set in the case, a bladder within the gun body encapsu lating the gun tube and having ends connected to a surface adjacent the gun tube and along an interface circumscribing an axis of the gun body, and explosive between the case and the liner;

minimizing a pressure differential across a sidewall of the gun body by directing fluid adjacent an outer surface of the gun body into the annulus.

10. The method of claim 9, wherein the step of pressurizing the annulus comprises communicating pressure ambient to the gun body to the annulus.

11. The method of claim 9, further comprising detonating the shaped charges.

* * * * *